US005996292A

United States Patent [19]

Hill et al.

[11] Patent Number: 5,996,292

[45] **Date of Patent: *Dec. 7, 1999**

[54] PERFORATED SHUTTER SYSTEM AND METHOD

[75] Inventors: George Anthony Hill, 8561 NW. 52nd St., Lauderhill, Fla. 33351; Larry H. Cohen, Highland Park, Ill.

[73] Assignee: George Anthony Hill, Lauderhill, Fla.

[ * ] Notice: This patent is subject to a terminal disclaimer.

[21] Appl. No.: 08/966,045

[22] Filed: Nov. 7, 1997

Related U.S. Application Data

[63] Continuation of application No. 08/723,893, Oct. 1, 1996, abandoned.

[51] Int. Cl.[6] ..... E06B 3/26

[52] U.S. Cl. ..... 52/202; 52/783.12; 52/748.1; 49/57; 49/61

[58] Field of Search ..... 52/202, 203, 783.11, 52/783.12, 783.13, 783.14, 783.15, 784.1, 579, 746.1, 748.1; 49/57, 61, 62, 464

[56] References Cited

U.S. PATENT DOCUMENTS

| | | |
|---|---|---|
| 5,426,893 | 6/1995 | Hoffman . |
| 5,457,921 | 10/1995 | Kostrzecha . |
| 5,487,244 | 1/1996 | Hill . |
| 5,570,542 | 11/1996 | Cameron . |

*Primary Examiner*—Creighton Smith
*Attorney, Agent, or Firm*—Jack E. Dominik

[57] ABSTRACT

Disclosed is a shutter system and its panels in which at least one panel is formed of corrugations, and in which the subject panel is perforated. Ideally, the perforation is employed in a panel having an isosceles trapezoidal rib, with the perforations running the full length of the face of the rib. The adjacent panels are secured by a wide variety of means often implying a keyhole slot at the top and the bottom of each panel to engage a fastening means which is secured to the structure being covered. Different mountings including direct mountings, of course, are contemplated. The panels, whether perforated or not, are formed from essentially the same material and as a consequence thermal expansion and contraction between adjacent panels is accommodated by the mutual expansion and contraction of each, thereby requiring only accommodation of the shutter system with regard to the opening in the dwelling which it closes.

18 Claims, 3 Drawing Sheets

PERFORATED SHUTTER SYSTEM AND METHOD

CROSS-REFERENCE TO RELATED APPLICATION

The present application is a continuation of application Ser. No. 08/723,893 filed Oct. 1, 1996, now abandoned, by the same inventors herein, entitled "Perforated Shutter System and Method".

BACKGROUND OF THE INVENTION

The present invention is directed to hurricane shutters generally of the type which are removably secured to openings in a building structure, more particularly the windows and doors of a house. The same can also be used in structures which are operated part-time to inhibit break-in as well as window breakage due to stray flying objects.

SUMMARY OF THE PRIOR ART

The prior art is best exemplified in U.S. Pat. No. 5,487,244 issued Jan. 30, 1996, to one of the co-inventors of the present application. The shutters shown in the subject patent are easily removably secured in a system to a structure such as a house as illustrated in FIG. 1. Other pertinent patents are U.S. Pat. Nos. 5,345,716; 5,383,315; 5,426,893; 4,637,444; 4,562,666; and 5,487,921. Most of the subject prior-art patents are either directed to an imperforate panel which, while shielding from flying debris, shuts out all light. On the other hand, the transparent plastic panels such as exemplified in U.S. Pat. No. 5,487,921 utilize transparent sheet. This introduces additional cost and an area of weakness. While light is admitted the specification of the subject patent concedes that utilizing plastic materials can result in varying degrees of thermal expansion and contraction. In addition, many transparent plastics lose their original impact resistance after 2,000 to 3,000 hours of ultra violet exposure. The strength of such panels can be reduced by more than 50% during this time period. As a consequence, when it is desirable to permit light to enter, and yet the panels of a shutter system are to be compatible, the utilization of a transparent or translucent plastic can prove costly. Also, it is a well known fact that polycarbonates such as disclosed in U.S. Pat. No. 5,487,921 are combustible. Hence, even though they may be able to resist hurricane loads, there is a risk that subsequent fire will ignite the same and could cause the development of noxious of not toxic fumes. The patent to Tanner, U.S. Pat. No. 4,637,444 shows an expanded metal. This will introduce light but is far too weak for a hurricane shutter. Additional prior art is exemplified by Kostrzecha U.S. Pat. No. 5,457,921 directed to a shutter system which is transparent. Further prior art is exemplified by Cameron U.S. Pat. No. 5,570,542 which shows a perforated insert for use on the window of a vehicle. Both of these, being transparent must be formed of a plastic or glass. The plastic will deteriorate with ultraviolet exposure as indicated above and in a relatively short period of time and becomes insufficient to withstand hurricane forces. Moreover, Cameron is not physically configured to provide any strength whatsoever. Thus, both Cameron and Kostrzecha fail to solve the problem of a hurricane shutter system which is strong enough to be acceptable with most hurricane area building codes. They are not durable enough to last for a long period of time subjected to ultraviolet bombardment. Finally, they are inherently expensive when contrasted to metallic shutters. Hence, it still remains to solve the problem of adequate protection against hurricane force winds and flying objects, while still providing for interior illumination.

SUMMARY OF THE INVENTION

The present invention is directed to a shutter system and its panels in which at least one panel is formed of corrugations, and in which the subject panel is perforated. Ideally, the perforation is employed in a panel having an isosceles trapezoidal rib, with the perforations running the full length of the face of the rib. The adjacent panels are secured by a wide variety of means often implying a keyhole slot at the top and the bottom of each panel to engage a fastening means which is secured to the structure being covered. Different mountings including direct mountings, of course, are contemplated. The panels, whether perforated or not, are formed from essentially the same material and as a consequence thermal expansion and contraction between adjacent panels is accommodated by the mutual expansion and contraction of each, thereby requiring only accommodation of the shutter system with regard to the opening in the dwelling which it closes.

Accordingly, it is a principal object of the present invention to provide a shutter system and method in which at least one shutter panel of the panel assembly is perforated to admit light and therefore preclude the shielded area from being in total darkness when there is available outside light.

Yet another object of the invention is to provide a shutter system and method in which the perforated panel portion of the shutter stores nestingly with a non-perforated panel which may be used in the same assembly since the perforated panel is formed to exactly the same configuration as the non-perforated panel.

Yet another object of the present invention is to provide a perforated panel for use in a shutter system which is cost effective in that it requires no additional material, no additional securing means, and no additional surface treating other than the non-perforated panel. With an imperforate panel buffeting can occur due to wind gusts and other irregularities. This creates almost a bellows-type action with the imperforate-type shutter. With the perforated shutter panel, however, a dampening effect occurs and the buffeting is significantly reduced. This in turn leads to a better relationship between the panel and the window or other area being covered and, of course, is another object of this invention.

BRIEF DESCRIPTION OF THE DRAWINGS

The subject invention will be better understood, and the objects and advantages set forth above explained, as the following description of an illustrative embodiment takes place in the drawings, in which.

DESCRIPTION OF A PREFERRED EMBODIMENT

Figure 1:
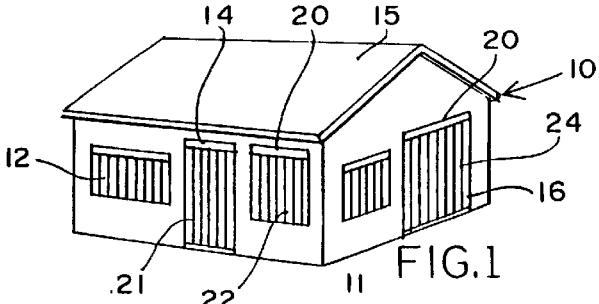
FIG. 1 is a perspective view of a house showing a typical installation of the subject hurricane shutter system and perforated panels.

A typical installation of the subject shutter systems in several applications is shown in FIG. 1. There it will be seen that the house 10 has a plurality of walls 11 beneath the roof 15, and windows 12. A door 14 is centrally disposed in the front wall of the building 10, and a sliding door 16 at a sidewall portion of the building 10.

The shutter system 20 as installed, in broad outline, will be best illustrated by reference to FIG. 2. There it will be seen that a plurality of shutter panels 30 have been joined together in a typical slide door 16 type installation. The sliding door shutter system 24 is noted in FIG. 1 where it will also be noted that there is a door shutter system 21 and a window shutter system 22.

Figure 4:
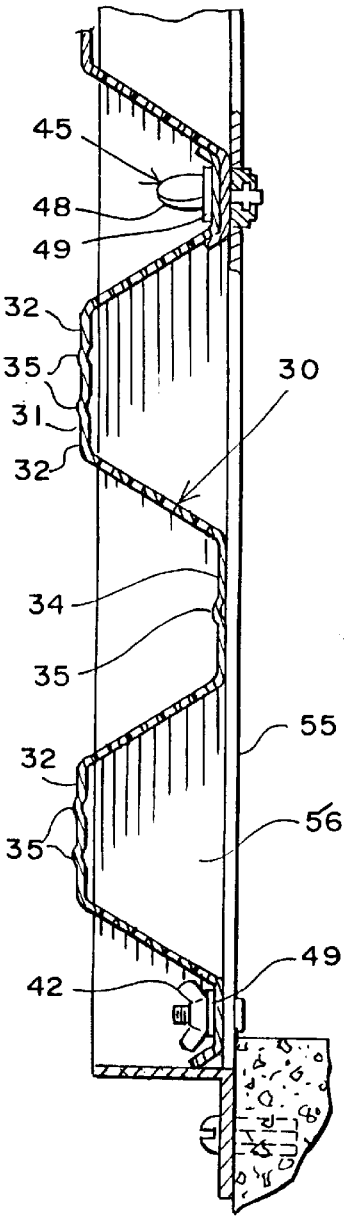
FIG. 4 is a further cutaway view illustrating the shutter panel taken along section line 2—2 of FIG. 2.
Figure 5:
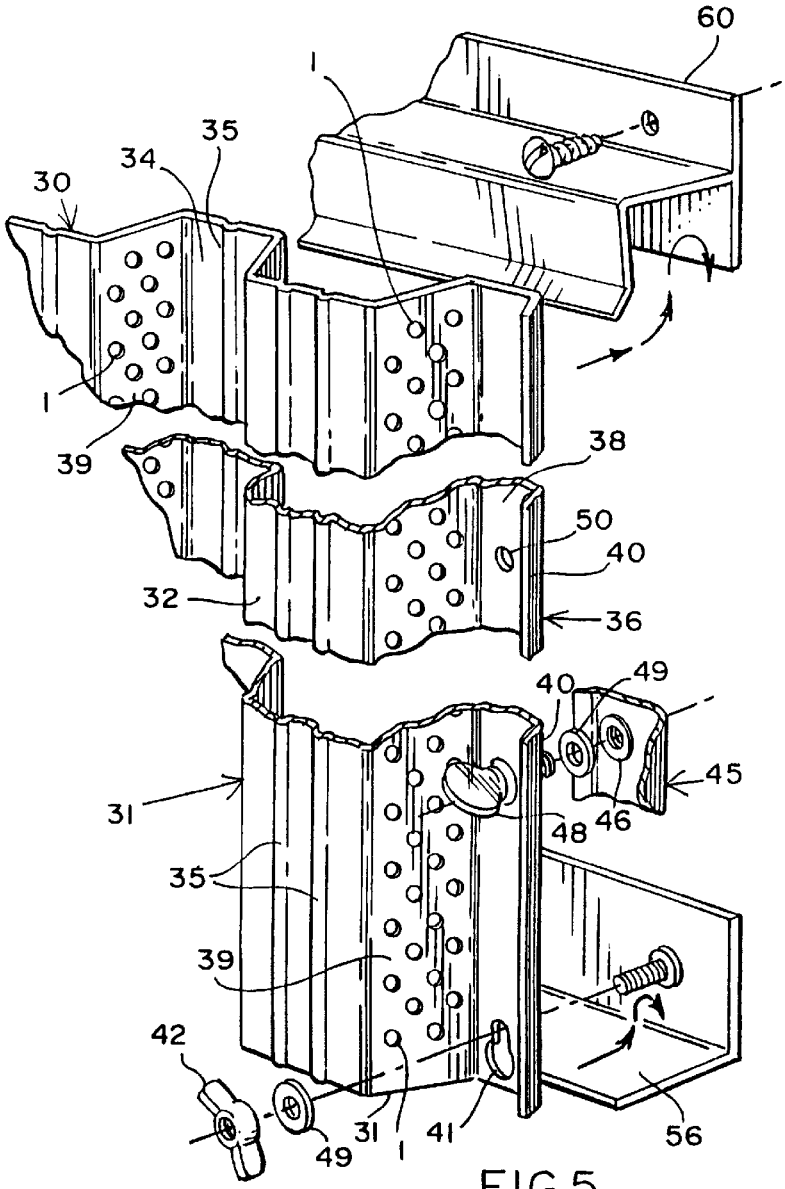
FIG. 5 is an exploded perspective showing one of the subject perforated panels in exploded perspective and related to a header and a footer.

Turning now to FIGS. 4, 5 it will be seen that the illustrative shutter panel 30 includes a plurality of isosceles trapezoidal corrugations 31, including a ridge 32, and a groove portion 34. Ribs 35 are provided, as shown here, two on the ridge 32 and one centrally disposed on the bottom of the groove 34. Normally the height of the two corrugations 31 is two inches, the groove 34 is two inches, and the spacing of the top portion are 4.5 inches. A 0.063 thick aluminum 5052-H32 alloy or 20 gauge steel ASTM B209-92A is employed.

Turning now to FIG. 5, there it will be seen that the lateral lip 36 has a lip bottom 38 and a lip edge lock 40. A keyhole opening 41 is provided in the lip bottom 38 at the lower extremity of the panel 30. The upper portion of the panel 30 mounts optionally in a header 60 which may take various configurations.

Turning now to FIG. 4 it will be seen that the panel lock assembly 45 includes a jack nut 46 which is secured to the lip channel 38 of the lip 36. A thumb screw 48 penetrates the lip bottom 38, passes through jack nut washer 49, and is threadedly engaged in the jack nut 46 by merely rotating with the thumb and forefinger.

Various foot constructions and header constructions, or direct mounting, are contemplated. In the construction of FIG. 5, the foot 55 has a bottom 56 which is secured to a concrete or masonry or other type of sill at the lower portion of the bottom 56 of the foot 55. The shutter is engaged by the wing nut 42. In the system of FIG. 5 the header 60 includes a wall mount portion 61 and the header mount 62.

To further impart strength to the system 20, a pair of spaced longitudinal ribs 35 are optionally provided on the upper portion of the corrugation 31, with a single longitudinal rib 35 on the lower groove portion 34. The header 60 is provided with spacing of 2.15 inches at the narrowest portion to snugly receive each of the panels 30 as it is slipped upwardly into the header 60, and then lowered onto the footer.

Each of the panels is provided with one or more jack nuts 46 which has its female portion securely mounted to the lip 36 of the underlying lip bottom 30 on the panel 30, and in spaced relationship longitudinally along the joint. A thumb screw 48 is provided to secure from the overlapping adjacent panel through the underlying fixed jack nut 46.

At the other end of the joint, a keyhole slot 41 is provided in both sides so that a bolt secured from the rear portion of the L-shaped receiver can be mounted as a hanger. To this end, a keyhole slot is provided in which the dimensions of the slot are at least 25% to 50% larger than the diameter of the bolt. The round portion of the keyhole slot is significantly larger. With the hole that the wing nut passes through to the fixed nut on the underlying lower shoe of the panel, a 25% to 50% oversized hole is also desirably added.

When the header 60 and sill are not employed 28, the shutters are ideally secured by anchors in concrete which are one-quarter inch tapcons, one and three-quarter inch imbedded or equivalent. For removable applications, it is best to use Rawl Caulk-In anchors which are one-quarter inch by seven-eighths inch imbedded or equivalent.

All bolts, nuts, and washers are ideally stainless steel or aluminum alloy 2024-T4 or 7075-T6 or plated steel. The ideal ceiling header 60 has a foot portion 0.062 inches thick, with the bridge and overlap 0.100 inches. The same is proportioned so that the foot extends at least one-half inch beyond the shadow of the overlapping securing top member to permit easy access for drilling to secure the same to a wall.

More specifically, the panels 30 are ideally 0.063 aluminum alloy 5052-832 or 20 gauge steel ASTMB 209-92A. They have a nominal width of twelve inches, with a total width of 13.5 inches, forming two inch deep ribs. The minimum deflection separation to existing glass which is to be protected is two and one quarter inches for an aluminum panel, and two and three quarter inches for a steel panel, both of which are imperforate. The maximum clearance between the top of the panel and the inside of the header is one-quarter inches. As to special requirements, a one-quarter inch by one-half inch thumb screw 48 with washer 49 goes into the jack nut 46. They are spaced at twenty-four inch centers longitudinally along the joint, and are used to join all panels at the lap joints.

Figure 3:
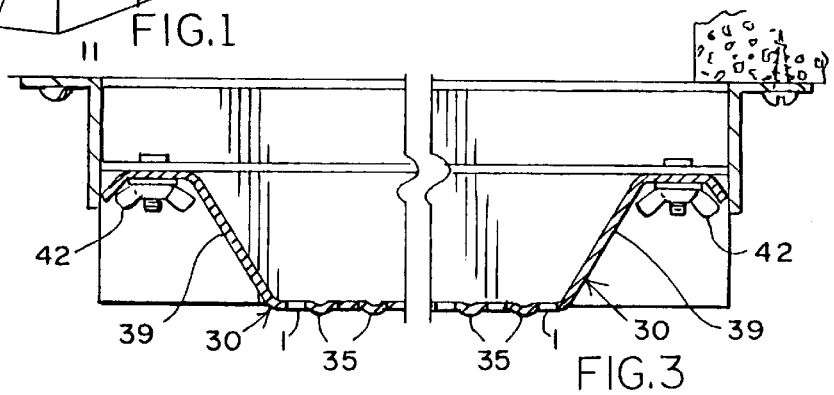
FIG. 3 is a transverse sectional view, in enlarged scale and broken, taken along section line 3—3 of FIG. 2 to illustrate the isosceles trapezoidal nature of the corrugated shutter.
Figure 2:
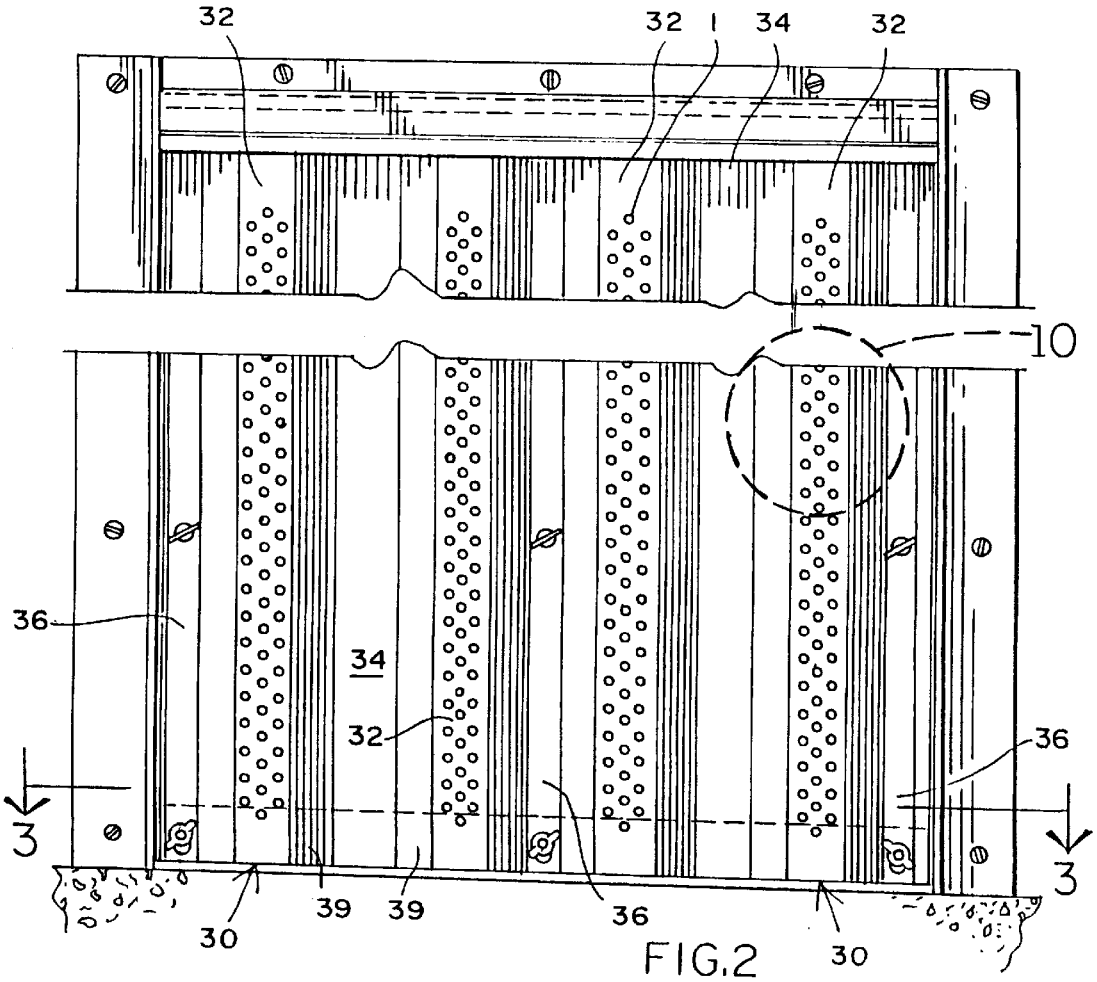
FIG. 2 is a front elevation, partially broken between top and bottom, to illustrate the plan view or front elevation of a shutter system typically enclosing a portion of the building structure such as shown in FIG. 1.
Figure 6:
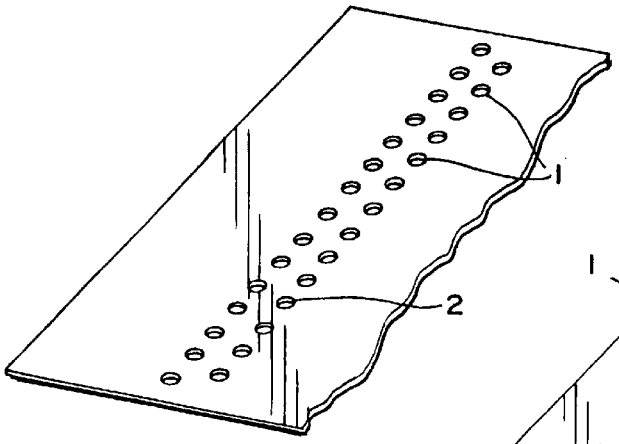
FIG. 6 discloses the perforation pattern of one embodiment prior to the panel being formed into a corrugated structure with flanking mounting channels and retainer lips.
Figure 7:
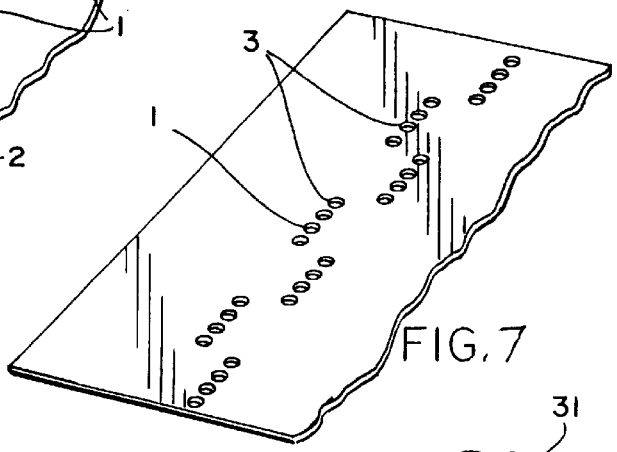
FIG. 7 is an alternative embodiment of the pattern for perforation as shown in FIG. 6.
Figure 8:
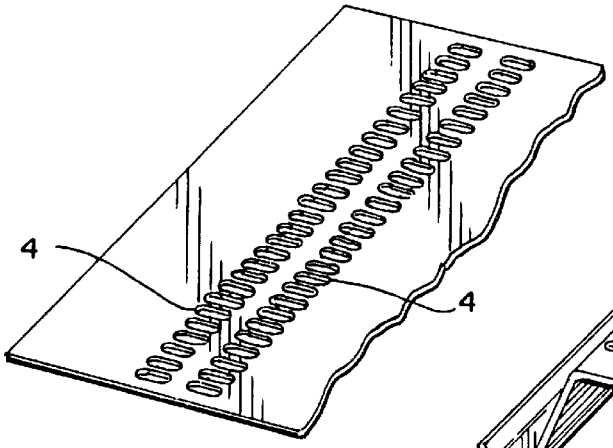
FIG. 8 is yet another embodiment of the perforations which can be used in the panels of FIGS. 6 and 7.
Figure 9:
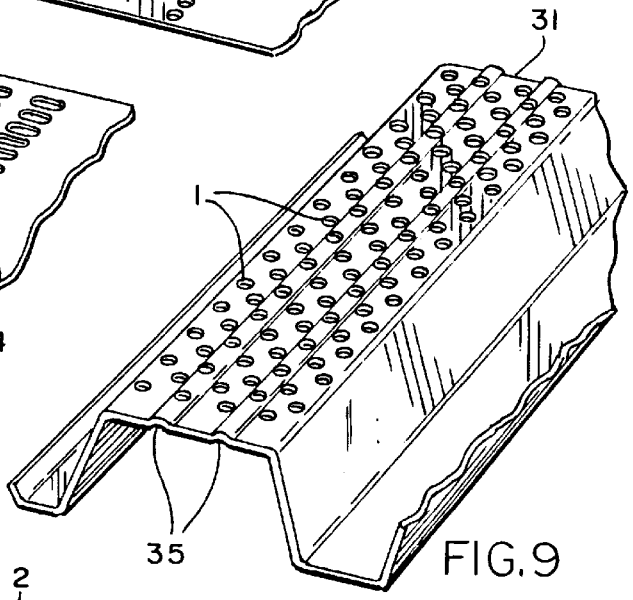
FIG. 9 is yet another example, but showing the positioning of the perforations on a top broken portion of a corrugation.
Figure 10:
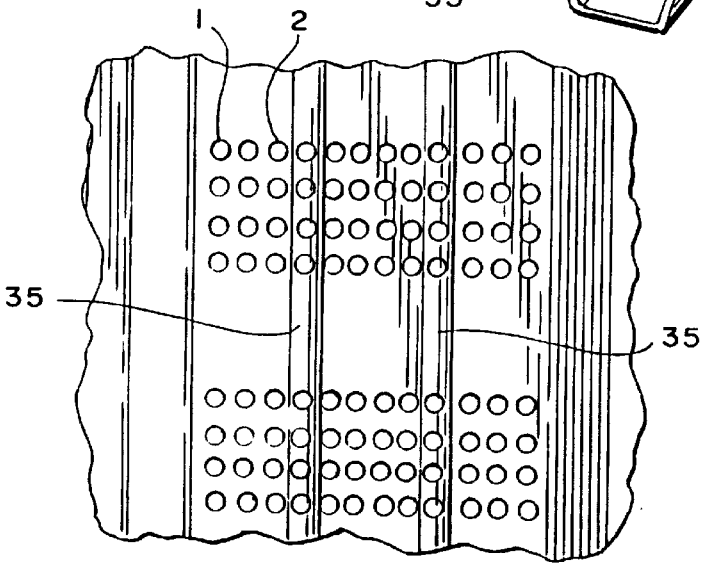
FIG. 10 is a top view of an illustrative corrugation which is perforated and is an enlarged section taken from the bullseye in FIG. 2.

More specifically, and in detailed showing of the present invention perforated panel, the same is illustrated in FIGS. 6–10 in the sheet form prior to roll forming into the corrugated structure of FIGS. 2 and 3. In FIG. 6, for example, the perforations 1 are in two parallel rows 2 spaced to the end that the perforations 1 will be on the upper portion of the isosceles corrugated rib 2 of the panel 30. The panels 30 ideally include two longitudinal ribs 35. Also noted is that interiorly of the outer portion of the rib, two smaller internal reversely formed ribs appear. Desirably, the perforations are uniformly disbursed in the parallel fashion on the bands 2 as shown in FIG. 6, and the alternative embodiment in FIG. 7, without reference to the small ribs which are formed irrespective of the location of the holes and the surrounding metal area formed by the perforations. FIG. 3 illustrates space clusters 3 of perforations 1. FIG. 8 discloses slot-like perforations 4.

In a tested version of the subject panel 10 in accordance with Dade County Florida code, the perforation were ⅛ inch holes, in two 1.25 inch bands down each panel and on 7/32 centers. There are 24 holes per square inch providing 29% open area in a given panel. The testing performed, which will qualify for Dade County, Florida, approval, included large missile impact test; large missile and cyclic wind pressure test; large missile impact and cyclic wind pressure test; uniform static air pressure test; all of which are recorded with Hurricane Engineering and Testing, Inc., located at 8532 N.W. 64th Street, Miami, Fla. 33166. The basic results from a standpoint of deflection show a three-inch deflection with the perforated panel whether aluminum, or steel, whereas the unperforated panel in aluminum deflects 2.25 inches, and an unperforated steel panel deflects 2.75 inches. Thus, the subject perforated panels must be mounted four inches away from the glass which will permit a three-inch deflection and not result in contact.

The weight per linear foot of panel is as follows:

| | Normal | Perforated |
|---|---|---|
| Aluminum | 1.33 lbs. | 1.25 lbs. (6.2% less) |
| Steel | 2.33 lbs. | 2.19 lbs. (6.2% less) |

The total weight per average house shutters:

| | Normal | Perforated |
|---|---|---|
| Aluminum | 665 lbs. | 623.77 lbs. (41 lbs. lighter) |
| Steel | 1165 lbs. | 1092.77 lbs. (72 lbs. lighter) |

The costs on the average three-bedroom, two-bath house with two sliding doors for aluminum and steel are compared as follows:

| | Normal | Perforated |
|---|---|---|
| Aluminum | $3,450 | $3,950 ($500 pr 14.5% premium) |
| Steel | $2,450 | $2,950 ($500 pr 20.4% premium) |

It has been demonstrated that the subject perforated panels, when perforated to an extent not to exceed 30% of the total surface area of the panel, and more particularly not to exceed 50% of the area being perforated with the removed material, both strength tests of the static and dynamic variety show the shutter panel to be substantially the equivalent of a non-perforated panel.

The method of the present invention is directed to taking a typical corrugated aluminum or steel panel and then perforating the same not to exceed 30% along the isosceles, trapezoidal corrugation which is the top in parallel with the lips and edges. Desirably, the lateral lips are provided with means for removably securing them to the adjacent lips. In operation, once the panel is perforated, a plurality is set up across an opening, whether it be window or door. They are either secured beneath a header and on top of a footer, or secured directly to the wall surrounding the opening in the enclosure where the shutters are to be provided.

Visual tests confirm that a significant amount of light will come into a room when the subject panels are employed. Moreover, one observing out the window, traffic moving by is distinguishable, as well as figures, trees, shrubs, and the like. One may not me able to detect all the leaves on the tree, but there is sufficient visibility to determine that there are indeed leaves. In addition, colors do not degrade significantly when observed through the subject perforated panels.

As shown in FIGS. 4 and 5, it is also contemplated that the perforations 1 can be applied to the groove 34 or lateral sides 39 of the corrugated panel. What is important is that the perforated portion not significantly exceed 30% of the area of the panel which would degrade the strength characteristics to an undesirable level. The optional showing of perforations on the lateral sides 39 of the rib 35 is shown in FIG. 5. Similarly the perforations can be in the groove 34 is shown in FIG. 4, or any combination of preferably flat surfaces.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A building structure glass closure hurricane protection system comprising, in combination, a building structure said building structure having a glass closure in an opening therein, a plurality of shutter panels for protecting said glass closure in the building structure opening, each shutter panel being formed of a corrugated opaque metallic body having a central groove and parallel flanking ridges, means for securing said shutter panels to overlie the glass closure, said groove and ridges of said shutter panel each having a surface area and comprising an isosceles trapezoidal cross-section;

and a perforated pattern preformed in one of said shutter panel ridges, which perforations remove the surface area on the ridge to an amount of not less than 10% and not more than 50%, whereby said glass closure hurricane system for use with a plurality of like shutter panels, whether perforated or note will permit the passage of light and air through the shutter panels to the glass enclosure to which the same has been secured.

2. In the closure system of claim 1 above, said perforations being uniformly spaced along substantially the entire length of the shutter ridges.

3. In the closure system of claim 1 above, said perforations being formed on the ridges of all of the isosceles trapezoidal ridges.

4. In the closure system, of claim 1 above, said perforations being substantially one-eighth inch in diameter and on seven thirty-second inch centers providing over twenty holes per square inch.

5. A building structure with at least one glass covered opening in combination with a hurricane-resistant system comprising, in combination, a shutter system for enclosing said glass covered opening, a plurality of corrugated shutter panels forming said system, each having central groove and parallel flanking ridges, said groove and ridges comprising an isosceles trapezoidal cross-section, said panels all having lateral edges, and a head and a foot, a perforated pattern preformed in at least one of said ridges thereby forming a perforated panel, means on the lateral edges of each of said panels for removably securing the same each to the other in substantially uniform vertically spaced relationship, and further means on the head and the foot of such panels to secure the plurality of panels over the opening in the building structure.

6. In the shutter system of claim 5 above, said panels being secured at the head and foot by removable securing means positioned outside the glass closure.

7. A method for forming a hurricane shutter system to cover a glass covered opening in a building structure to resist high wind velocities while yet permitting the passage of light and air into the interior portion of the building structure through the opening therein comprising the steps of:

forming a plurality of shutter panels each of which has at least one isosceles trapezoidal rib and lateral edges extending longitudinally thereof, perforating such rib with a uniform pattern of perforations containing not less than twenty perforations per square inch, and removably securing each of said panels to adjacent panels along the lateral edges by removable securing means.

8. In the shutter system of claim 7 above, said removable securing means being uniformly spaced vertically along the lateral edges of each of said panels.

9. A building and hurricane shutter system in which said building has a glass covered opening therein in which said system includes, in combination, a plurality of corrugated shutter panels having central groove and parallel flanking ridges, said groove and ridges comprising an isosceles trapezoidal cross-section, a perforated pattern preformed in at least one of said ridges, means on the lateral edges of each of said panels for removably securing the same each to the other in substantially uniform vertically spaced relationship, whereby light and air can enter the building while the hurricane system is fully engaged.

10. A shutter panel for use with a shutter system for overlying an opening in a building structure, comprising, in combination, a corrugated elongate body having at least one essentially isosceles trapezoidal rib with a flat outward top, and a perforated pattern pre-formed on said rib, and lateral overlapping gutters along said body for removable securement to an adjacent-like panel.

11. In the shutter panel of claim 10 above, said perforations being uniformly spaced along substantially the entire length of the shutter.

12. In the shutter panel of claim 10 above, said perforations being formed on the ribs of all of the isosceles trapezoidal ribs.

13. In the shutter panel of claim 10 above, said perforations being substantially one-eighth inch in diameter and on seven thirty-second inch centers providing over twenty holes per square inch.

14. In the shutter system of claim 10 above, said panels being secured at the head and foot by removable securing means positioned outside the building structure.

15. A shutter panel for use with a shutter system for overlying an opening in a building structure, comprising, in combination, a corrugated elongate body having at least one essentially isosceles trapezoidal rib with a flat outward top, tapering flat sides, and a flat groove at the bottom portion of at least one of said sides, a perforated pattern preformed on at least one of said flat member, said perforations being formed on the tops of all of the isosceles trapezoidal ribs.

16. In the shutter panel of claim 15 above, said perforations being uniformly spaced along substantially the entire length of the shutter.

17. In the shutter panel of claim 15 above, said perforations being substantially one-eighth inch in diameter and on seven thirty-second inch centers providing over twenty holes per square inch.

18. In the shutter system of claim 15 above, said panels being secured at the head and foot by removable securing means positioned outside the enclosure.

* * * * *